US005236073A

United States Patent [19]

DiPaolo et al.

[11] Patent Number: 5,236,073

[45] Date of Patent: Aug. 17, 1993

[54] COMBINATION COIN-CONTROLLED LOCK MECHANISM AND CALCULATOR FOR USE ON A SHOPPING CART

[76] Inventors: Anthony M. DiPaolo; John T. Hood, both of 18221 Edison Ave., Chesterfield, Mo. 63005

[21] Appl. No.: 905,755

[22] Filed: Jun. 29, 1992

[51] Int. Cl.[5] ..... G07F 7/00; G07F 17/10

[52] U.S. Cl. ..... 194/212; 194/905; 280/33.992

[58] Field of Search ..... 194/212, 905, 257; 280/33.992

[56] References Cited

U.S. PATENT DOCUMENTS 3,288,478 11/1966 Powers ..... 280/33.992
5,040,656 8/1991 DiPaolo et al. ..... 194/212

FOREIGN PATENT DOCUMENTS 0384855 8/1990 European Pat. Off. ..... 280/33.992
2623154 5/1989 France ..... 280/33.992

*Primary Examiner*—F. J. Bartuska

*Attorney, Agent, or Firm*—Senniger, Powers, Leavitt & Roedel

[57] ABSTRACT

Coin-controlled apparatus for locking shopping carts together in nested series at a cart parking station having coin-controlled mechanism mounted on a cart, e.g. on the handle of the cart, which is adapted for receiving and releasably locking therein a latch bar on a tether which is attached to the next cart in the nested series, requiring deposit of a coin to release the latch bar to free the cart for being wheeled away by the user, and holding the coin until the user brings the cart back to a cart parking station, nests it in the end cart at the parking station, and inserts the latch bar which is tethered to the end cart in the mechanism to lock the returned cart to the series and to provide for return of the user's coin, and a housing for a calculator at the bottom thereof, the calculator being movable from a retracted position in the housing to an extended position projecting out of the housing when the mechanism is operated to release the latch bar, and back to retracted position when the latch bar is inserted.

9 Claims, 6 Drawing Sheets

9
3B
145
A
181
175
163
165
167
155
179
173
171
177
161
157
159
151
141
153
143

3B
169
181
157,159
A
177
175
171
173
179
143

COMBINATION COIN-CONTROLLED LOCK MECHANISM AND CALCULATOR FOR USE ON A SHOPPING CART

BRIEF SUMMARY OF THE INVENTION

This invention relates to a combination coin-controlled lock mechanism and calculator for use on a shopping cart, and more particularly to apparatus for locking shopping carts together in nested series comprising coin-controlled mechanism which is mounted on a shopping cart and which is adapted for receiving and releasably locking therein a bar on a tether attached to the next cart in the series, and a calculator associated with the coin-controlled mechanism for use by a customer using the cart to calculate the total cost of items puchased, or for other calculations.

Reference is made to our U.S. Pat. No. 5,040,656 issued Aug. 20, 1991 and incorporated herein by reference showing coin-controlled apparatus for locking shopping carts together in nested series at a cart parking station having a coin-controlled mechanism mounted on a cart, e.g. on the handle of the cart, which is adapted for receiving and releasably locking therein a latch bar on a tether which is attached to the next cart in the nested series, requiring deposit of a coin to release the latch bar to free the cart for being wheeled away by the user, and holding the coin until the user brings the cart back to a cart parking station, nests it in the end cart at the parking station, and inserts the latch bar which is tethered to said end cart in the mechanism to lock the returned cart to the series and to provide for return of the user's coin.

Supermarket shoppers may wish to add up the prices of items selected for purchase and placed in the cart they are using, and among the several objects of the invention may be noted the provision of a lock mechanism/calculator assembly in which the calculator is movable from a retracted position in a housing associated with the lock mechanism for protection of the calculator, e.g. for protection from the weather, when the cart on which the lock mechanism and calculator housing are mounted is parked, e.g. in a corral outside the market, to an extended position outside the housing wherein it may be used by the shopper wheeling the cart to add up prices, or otherwise; the provision of such an assembly wherein the calculator is automatically moved to its extended position outside the housing by the operation of the lock mechanism to release a cart following deposit of a coin in the mechanism and automatically retracted when the cart is locked up; the provision of such an assembly having a closure for the housing which opens when the calculator moves to its extended position and closes when the calculator is retraced, and the provision of such an assembly in which the calculator is retained in association with the lock mechanism.

In general, a coin-controlled lock mechanism/calculator assembly of this invention comprises coin-controlled mechanism which is mounted on a cart and which is adapted for receiving and releasably locking therein a bar on a tether attached to the next cart in a nested series of carts; said mechanism comprising an elongate body having a top, bottom, sides and rearward and forward ends, with an elongate slideway for a coin slide extending therein from the rearward end thereof toward the forward end. The elongate body is adapted for being mounted in a generally horizontal position on a shopping cart. A coin slide is slidable in the slideway, the slide having a forward and a rearward portion, and being biased toward an outer rearward position wherein its rearward portion extends out rearward of the body. The rearward portion of the slide has a recess for holding a coin on edge therein with the coin projecting up out of the recess, the recess being located outwardly of the rearward end of the body when the slide is in its rearward position for deposit of a coin in the recess and retrieval of a coin from the recess and being located within the body when the slide is pushed inward and forward. The inward movement of the slide in the absence of a coin in the recess is limited but inward movement of the slide to a forward position inward of the limit is allowed as long as a coin is placed in the recess. Means is provided for locking the bar on the tether attached to the next cart in the series in the body, said locking means releasing the bar on inward movement of the coin slide to its forward position following insertion of a coin in the recess. A calculator housing is provided at the bottom of the body, this housing having a chamber therein extending lengthwise with respect to the body and an opening at the forward end of the housing. A calculator is movable in the chamber between a retracted position housed within the recess and an extended position projecting out of the chamber through said opening for use by a shopper using the cart, with means interconnecting the slide and the calculator for moving the calculator forward to its extended position when the slide is moved forward to its forward position and moving the calculator rearward to its retracted position when the slide is moved rearward to its rearward position. Other objects and features will be in part apparent and in part pointed out hereinafter.

BRIEF DESCRIPTION OF THE DRAWINGS

Corresponding reference characters indicate corresponding parts throughout several views of the drawings.

DETAILED DESCRIPTION

Figure 1A:
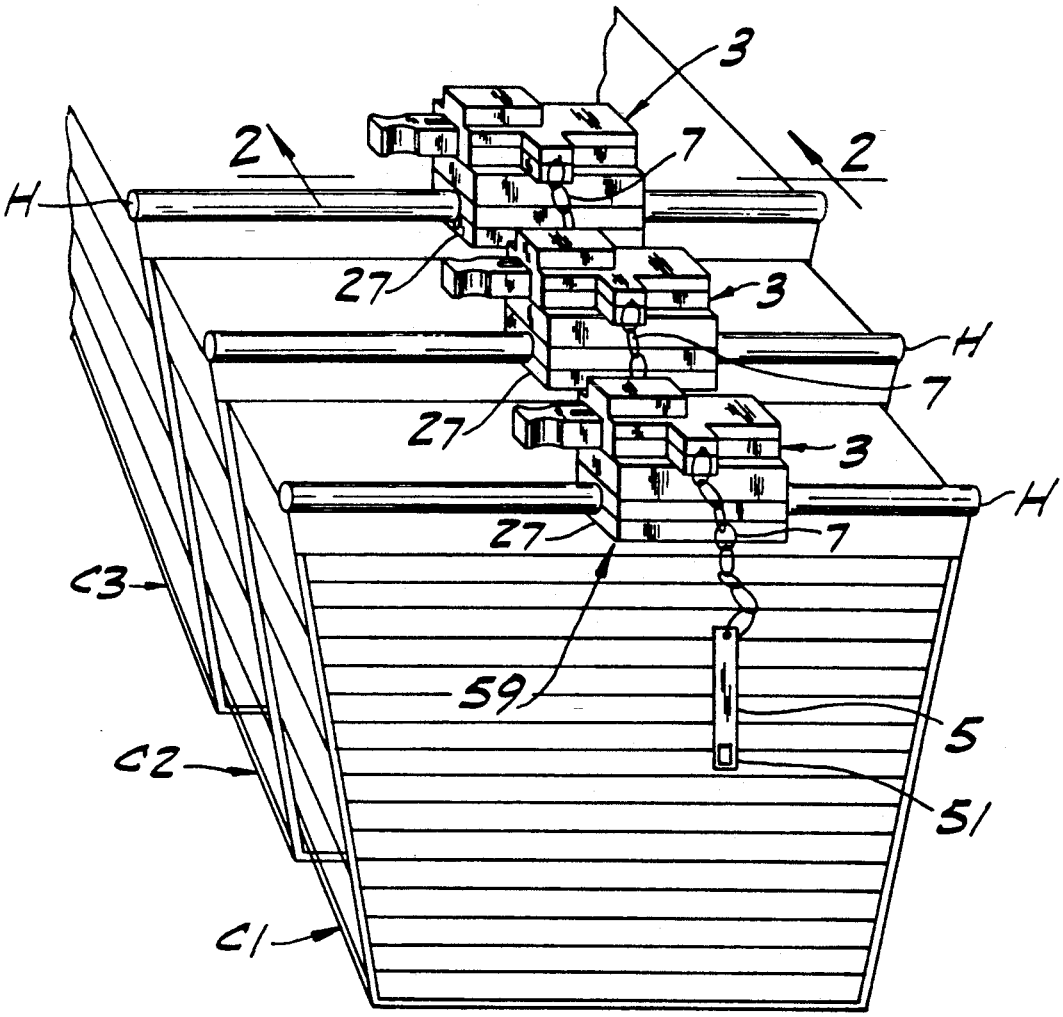
FIG. 1A is a generally perspective view showing a series of nested shopping carts locked together by a coin-controlled apparatus of this invention, the cart wheels being omitted.
Figure 1B:
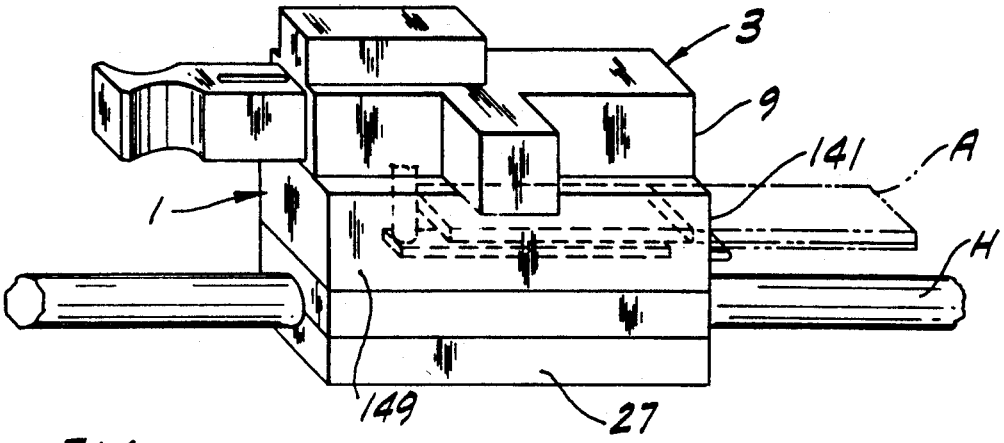
FIG. 1B is a generally perspective view of the coin-controlled apparatus per se, showing in phantom retracted and extended positions of a calculator of the apparatus.
Figure 1C:
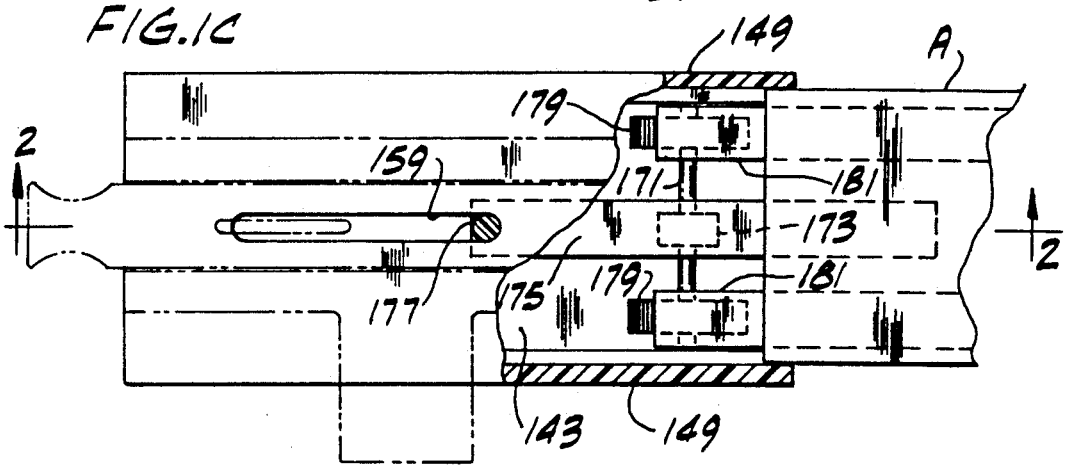
FIG. 1C is a plan of the apparatus with parts broken away and shown in section, and showing the calculator extended.

Referring first to FIG. 1 of the drawings, there is shown a series of shopping carts disposed in nested relation as at a cart parking station in the parking lot of a supermarket. Three such carts are shown, designated C1, C2 and C3, C1 being the end cart of the series nested in C2, and C2 being nested in C3. The handle of each cart is designated H; the cart wheels are omitted. At 1 is generally indicated coin-controlled apparatus of this invention for locking the carts together in the nested series and for carrying a calculator indicated at A, this apparatus comprising a coin-controlled mechanism designated in its entirety by the reference numeral 3 mounted on each cart, more particularly on the handle of the cart, each mechanism being adapted for receiving and releasably locking therein (under coin control) a latch bar 5 on a tether 7, preferably a chain, which is attached to the next cart (more particularly attached to the coin-controlled mechanism 3 on the next cart in the series). As illustrated in FIG. 1, cart C1 is locked to cart C2 by the latch bar 5 on the chain 7 extending from the mechanism 3 on cart C2 and cart C2 is locked to cart C3 by the latch bar 5 on the chain 7 extending from the mechanism 3 on cart C3. The chain 7 which is secured to the mechanism 3 on cart C1 is shown as hanging loose, awaiting insertion of the latch bar 5 on that chain in the mechanism 3 on the next cart which is wheeled up to be nested in cart C1.

Each coin mechanism 3 comprises an elongate body generally designated 9 having a top 11, bottom 13, sides 15 and 17 and ends 19 and 21, end 19 being referred to as the rearward end and end 21 being referred to as the forward end. The body is made to have an elongate opening 23 therein extending from its rearward end 19, where it is open, toward but terminating short of its forward end 21, where it is closed. This opening 23, which is of rectangular shape in transverse section, constitutes a slideway for a coin slide 25 which extends slidably therein from the rearward end 19 of the body toward the forward end 21. The body 9 is adapted for being mounted in a generally horizontal position on a shopping cart, more particularly in such position above the handle H of the cart extending lengthwise of the handle by having mounting means such as generally indicated at 27.

The elongate body 3 is of two-part construction comprising a lower part 29 (see FIGS. 10–13) generally of channel shape in cross section having an elongate bottom wall or web 31 (the bottom of which is the bottom 13 of the body), upwardly extending side walls 33 and 35 and a forward end wall 37, and an upper part 39 (see FIGS. 6–9) generally of inverted channel shape in cross section having an elongate upper wall 41 (the top of which is the top 11 of the body), downwardly extending side walls 43 and 45 and a forward end wall 47. All these walls have a height one-half the full body height. The two parts are assembled with the downwardly extending side walls of the upper part extending on the upwardly extending side walls of the lower part, and with the forward end wall of the upper part mating with the forward end wall of the lower part, the two parts being secured together as by screws as indicated at 49 in FIG. 5A. The slideway 23 is defined in the body 9 by the bottom wall 31 and side walls 33 and 35 of the lower part and the side walls 43 and 45 and top wall 41 of the upper part, the slide 25 generally being of rectangular cross section corresponding generally to the rectangular cross section of the slideway and having a relatively close sliding fit therein.

The latch bar 5 is a relatively thin flat elongate bar of rectangular cross section, e.g. five inches long, 9/16 inch wide and ¼ inch thick, having a rectangular hole 51 therein adjacent one end thereof, which may be referred to as its inner end, extending through the bar from one broad side thereof to the other. The body 9 is formed in its side 15 (constituted by walls 33 and 35 of parts 29 and 39), which is the side of the body which faces forward relative to the cart as the mechanism 3 is mounted on the handle of the cart, with a hole 53 for insertion of the latch bar. This hole is formed by a slot 55 in the upwardly extending side wall 33 of the lower part 29 of the body and an aligned slot 57 in the downwardly extending side wall 43 of the upper part 39 of the body, each slot forming half the hole. The body is also formed with a housing generally designated 59 on the side opposite the hole 53 extending laterally outwardly therefrom with a recess 61 in this housing and a second hole 63 transversely aligned with the hole 53 extendng between the slideway 23 and the recess 61 in said side housing 59. The latter comprises a lower part 65 on the outside of the lower part 29 of the body and an upper part 67 on the outside of the upper part 39 of the body. The lower part 65 has a bottom 69, and upwardly extending side walls 71 and 73 and an end wall 75, and the upper part 67 has a top 77, downwardly extending side walls 79 and 81 and an end wall 83, these walls all having a height one-half the body height and registering to form the housing 59 with the recess 61 therein. The hole 63 is narrower than the recess 61 and is located centrally at the end of the recess toward the slideway 23, defining shoulders 85 at the end of the recess toward the slideway 23. It is formed by a slot 87 in the upwardly extending side wall 35 of the lower part 29 of the body 9 and an aligned slot 89 in the downwardly extending side wall 45 of the upper part 39 of the body. End walls 75 and 83 meet to form a closed outer end for the housing 59.

The coin slide 25 has a forward (inner) portion indicated at 91 and a rearward (outer) portion 93, "forward" being in reference to the direction in which the slide is pushed in, and "rearward" being the reverse. A coil compression spring 95 accommodated in the slideway 23 toward its forward end acts from the closed end of the slideway at 21 against the forward end of the slide 25 to bias it rearward. The inner portion of the coin slide has an elongate slot 97 extending lengthwise thereof and extending therethrough from one side to the other. A detent 99 for the coin slide is pivoted by a pin 101 in a recess 103 in an auxiliary housing 105 on top of the body 9 adjacent the rearward end of the body. This detent has a pin 107 adjacent its free (forward) end which, when the detent is down, extends into an elongate slot 109 in the top of the forward portion 91 of the slide extending lengthwise thereof. The forward end 111 of this slot 109 constitutes a first stop engageable with the pin 107 of the detent to limit the rearward movement of the slide under the bias of the spring 95 to determine a rearward (outer) position of the slide (see FIG. 2). The rearward end 113 of the slot 109 constitutes a second stop engageable with the pin of the detent to prevent the slide from being pushed all the way in to its full forward (inner) position shown in FIGS. 4 and 5. The detent is biased downwardly toward the top of the slide by a coil compression spring 117 in the housing 105.

The rearward portion 93 of the slide 25 has a relatively deep narrow recess or pocket 119 for holding a coin, more particularly a U. S. quarter Q, on edge therein with the coin projecting up out of the recess as appears in FIGS. 2–4. The recess 119 is located outwardly of the rearward end of the body 9 when the slide is in its rearward position of FIG. 2 for deposit or insertion of a coin in the recess and for retrieval of a coin from the recess, and is located within the body when the slide is pushed inward and forward to its stated forward position, i.e. the position in which it is shown in FIGS. 4 and 5. The detent has a lower cam surface as indicated at 121 engageable with the top of the slide 25 as appears in FIG. 2 and with which the upper portion of the coin in the recess is engageable when the slide is pushed inward and forward in the body to raise the detent and thereby raise the pin 107 out of the slot 109 to allow the slide to be pushed all the way in to its said forward position. The recess 119 has a drain hole 122 to avoid collection of rainwater therein.

At 123 is indicated a latch for latching the slide 25 in its said forward position to hold a coin in the recess against retrieval as will appear. This latch is slidable in the recess 61 in the lateral or side housing 59 on the body 9 and in the hole 53, being of T-shape in plan having a stem 125 slidable in the hole 53 and a head 127 slidable in the recess 61, between a laterally retracted position clear of the slideway 23 wherein the stem 125 is back in the hole 53 (see FIG. 5A) and a slide-latching position wherein the stem 125 extends into and across the slideway 23 (see FIG. 5B). The latch 123 is biased by a coil compression spring 129 accommodated in the recess 61 between the outer end of the recess and the head 127 toward its slide-latching position. A tongue 131 for entry in the hole 51 in the latch bar 5 for locking the latch bar in the body 9 extends rearward from the forward end of the slot 97 in the slide 27 toward but terminating short of the rearward end of the slot to provide a space indicated at 133 for passage of the latch bar therethrough.

Each coin mechanism 3 has the respective latch bar chain 7 suitably attached securely at the other end of the chain from the latch bar 5 to the outer end of the lateral housing 59 of the mechanism. The coin mechanism is mounted on the handle of the cart with the housing 59 extending rearward with respect to the cart; thus as to the cart C1 as shown in FIG. 1, the chain 7 with the latch bar 5 thereon hangs down at the rear end of the cart in position where it is readily accessible to the user. Also as shown in FIG. 1, the coin slides 25 of the mechanisms on each of the three carts are in their rearward (outer) positions wherein the coin recesses 119 therein are accessible for dropping in a coin. The latch bar 5 on the chain 7 attached to cart C2 is locked in the mechanism 3 on cart C1, and the latch 5 on the chain 7 attached to cart C3 is locked in the mechanism on cart C2. Locking of the latch bars in the mechanism on carts C1 and C2 results from the tongues 131 of the coin slides 25 of these mechanisms extending through the holes 51 in the latch bars 5, thereby pinning the latch bars in the bodies 9 of the respective mechanisms.

Figure 4:
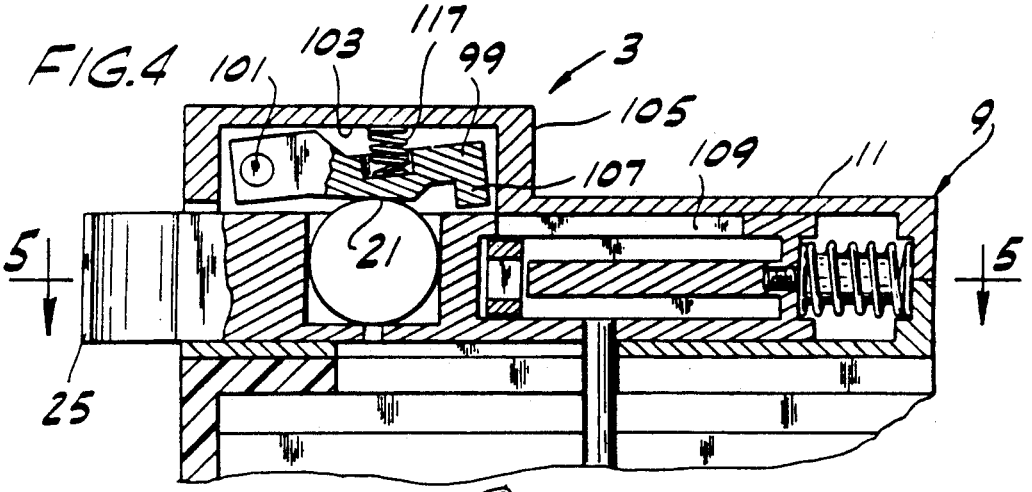
FIG. 4 is a view similar to FIGS. 2 and 3 showing the coin slide in its forward (inner) position.
Figure 5A:
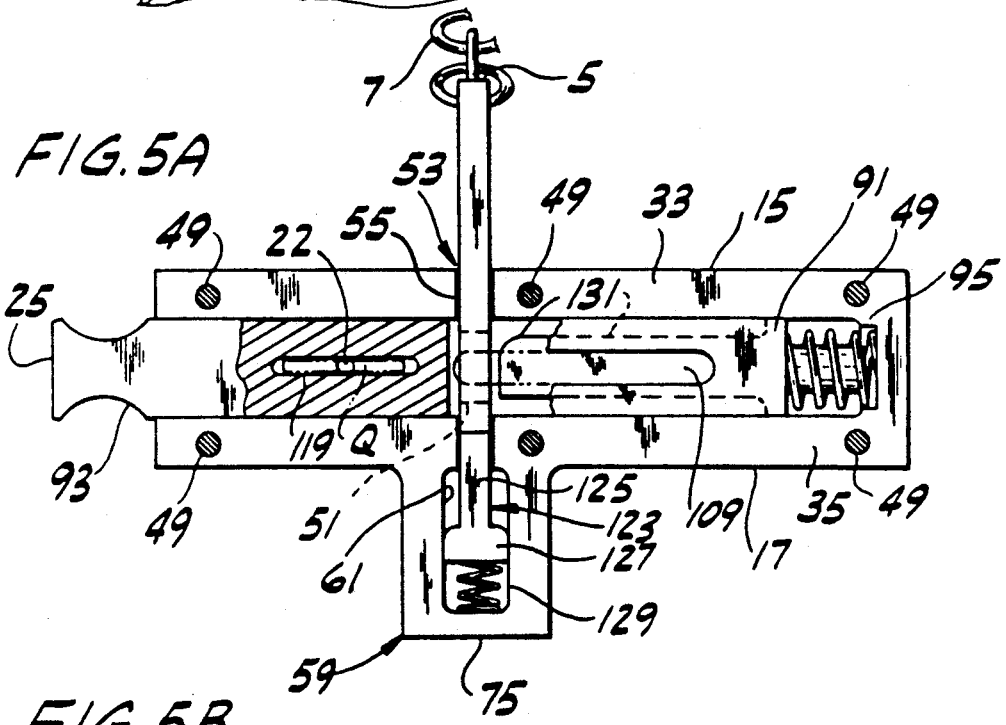
FIG. 5A is a horizontal longitudinal section generally on line 5—5 of FIG. 4 showing a latch bar of the apparatus in position extending across the slideway in the body of the mechanism just before it is pushed out by the slide latch of the apparatus.
Figure 5B:
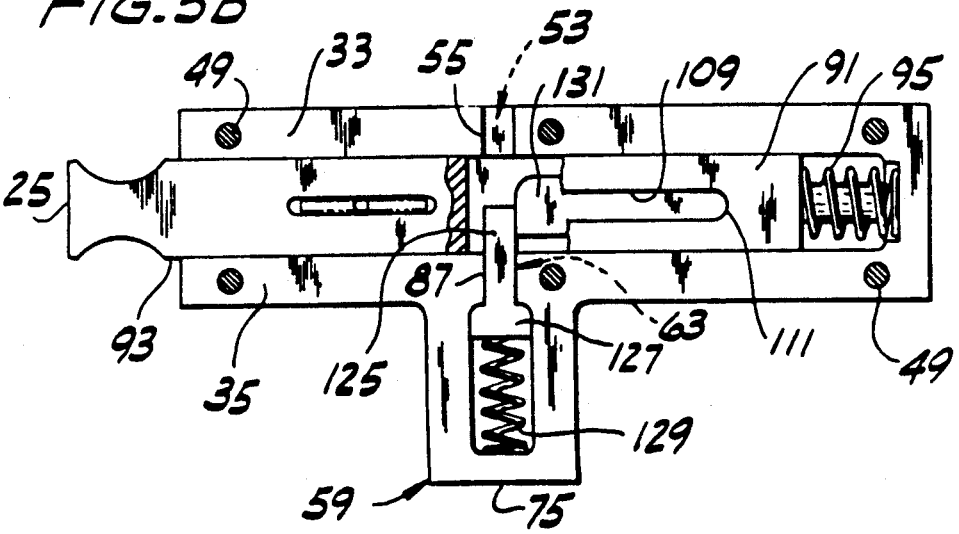
FIG. 5B is a view similar to FIG. 5A showing the slide latch in its slide-latching position, having pushed out the latch bar.
Figure 6:
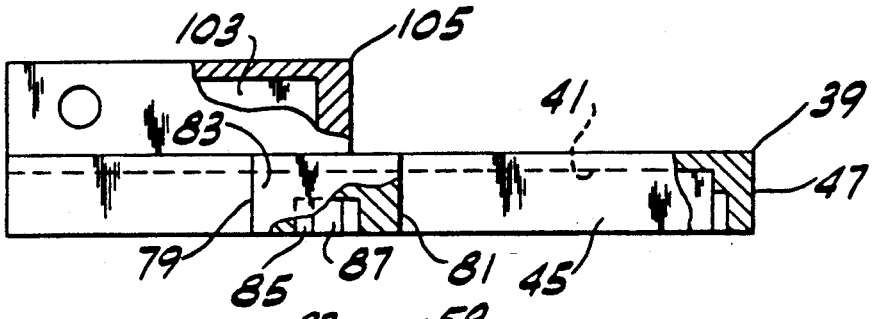
FIG. 6 is a view in elevation of one side of the upper part of the body of the mechanism, with parts broken away and shown in section.
Figure 7:
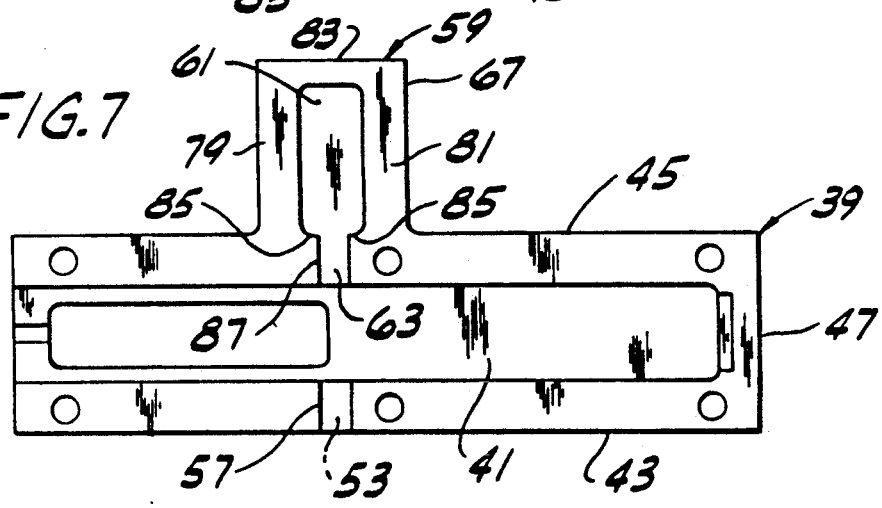
FIG. 7 is a bottom plan of the upper part.
Figure 8:
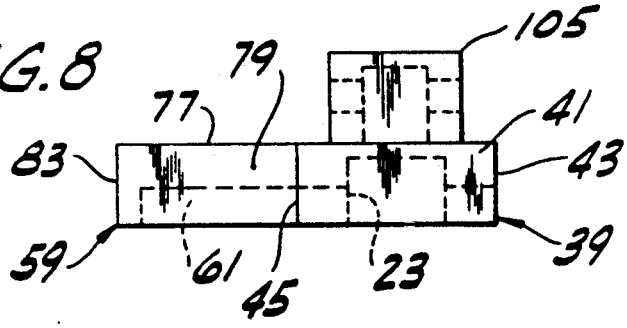
FIG. 8 is a view of the upper part from its left end.
Figure 9:
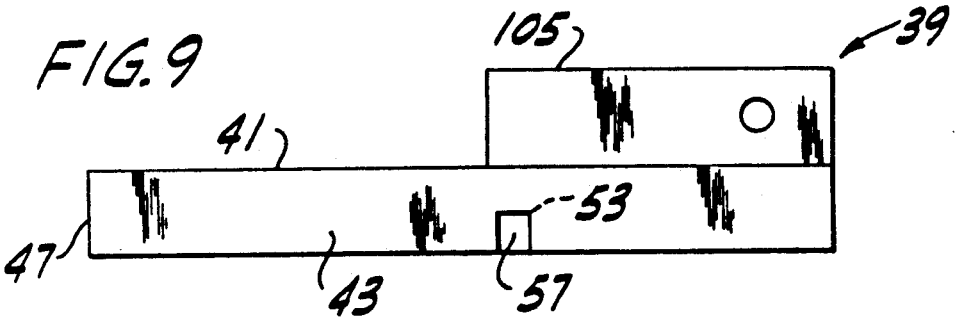
FIG. 9 is a view in elevation of the other side of the upper part.
Figure 10:
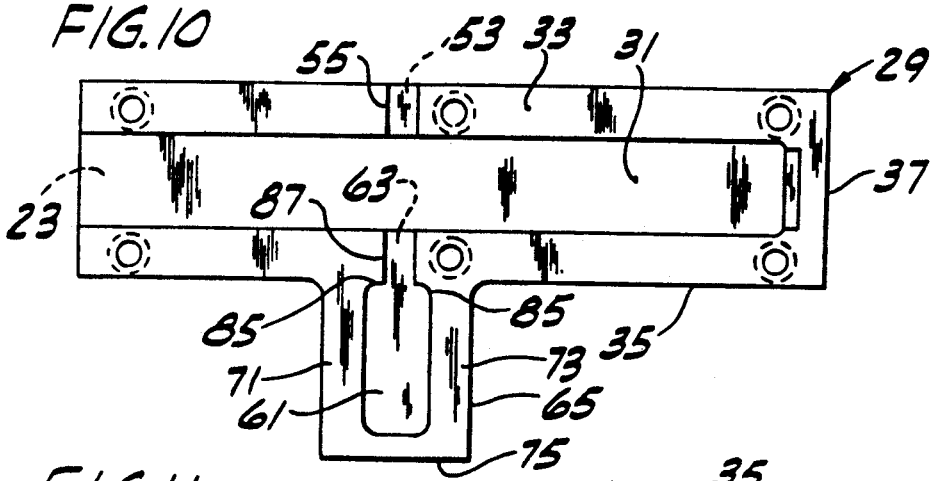
FIG. 10 is a plan of the lower part of the body.
Figure 11:
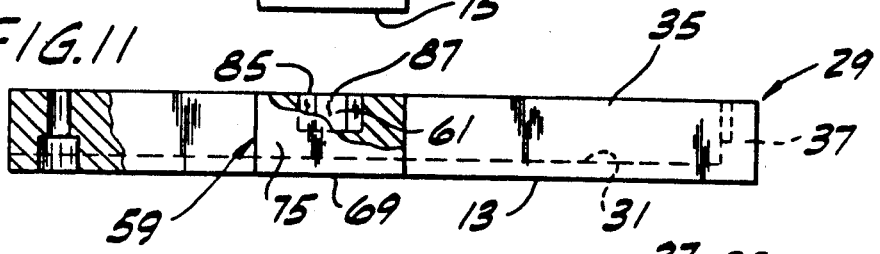
FIG. 11 is a view in elevation of one side of the lower part.
Figure 12:
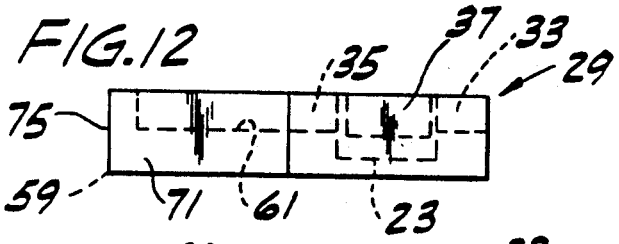
FIG. 12 is a view of the lower part from its right end.
Figure 13:
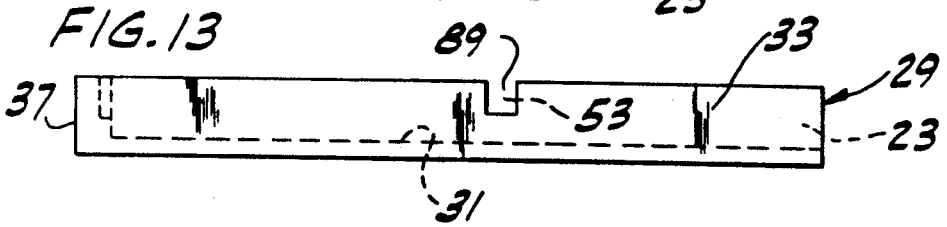
FIG. 13 is a view in elevation of the other side of the lower part.
Figure 14:
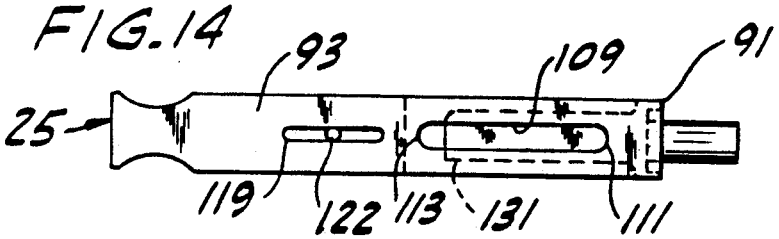
FIG. 14 is a plan of the coin slide per se.
Figure 15:
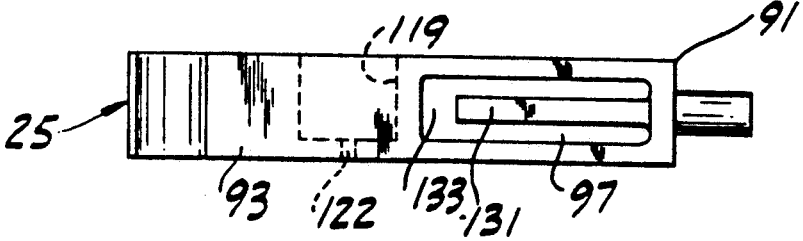
FIG. 15 is a view in elevation of one side of the coin slide.

To free cart C1 for being wheeled into the supermarket (or other establishment), the user drops a coin (a U. S. quarter Q as herein described) into the recess 119 in the rearward (outer) portion 93 of the coin slide 25 of the mechanism 3 on cart C1 and pushes the slide in all the way to its stated forward position, i.e. the position in which it is shown in FIGS. 4 and 5A. This is enabled by reason of the upper portion of the coin camming the detent 99 upward so that pin 107 clears the stop 113. When the slide is pushed in to its forward position, the tongue 131 is withdrawn from the hole 51 in the latch bar 5 on chain 7 which extends from cart C2 thereby unlocking the latch bar and freeing it for removal from the body of the mechanism on cart C1. Under the bias of spring 129, the slide latch 123 pushes the latch bar 5 in the direction for removal from the body 9 and moves into the space 133 between the rearward end of the tongue 131 and the rearward end of the slot 97; thereby assuming a slide-locking position wherein it is engaged by the tip of the tongue to lock the slide 25 in its said forward (inner) position and thereby hold the coin which is in the recess 119 inaccessible within the body. The user is enabled to obtain return of the coin, however, by returning the cart to the parking station where it was obtained, (or another parking station) and inserting the latch bar 5 on the chain extending from the end cart of the series at the station into the hole 53 and pushing it in against the slide latch 123 and through the space 133, thereby retracting the slide latch 123 to enable the slide 25 to be pushed forward by the spring 95, and the tongue 131 to pass through the hole 51 in the latch bar 5 to lock the returned cart to the series of carts.

As thus far described, the coin-controlled lock mechanism 3 of the lock mechanism/calculator assembly of this invention is substantially identical to the lock mechanism described in our aforesaid U.S. Pat. No. 5,040,656. In accordance with this invention, we provide the mechanism with an elongate calculator housing 141 at the bottom of the elongate body 9, this housing having recess or chamber 143 therein extending lengthwise with respect to the body 9 and having an opening 145 at its forward end. The housing 141 is shown as having a flat bottom 147, side walls each designated 149, a top 151, a rear end wall 153 and a partial forward end wall 155 the opening 145 being above the partial end wall. The housing 141 has a length corresponding to the length of the body 9, and is sandwiched between the body 9 and the mounting means 27. Thus, the housing 141 is mounted on the handle H of the shopping cart underlying the body 9 and extending lengthwise with respect to the handle. The bottom 13 of the body 9 has a longitudinal slot 157 on the longitudinal center line therof and the housing is shown as having a longitudinal slot 159 in the top wall registering with the slot 157. It will be understood that the housing may be made without the top 151, and the bottom 13 of the body 9 utilized as the top of the housing.

Figure 2:
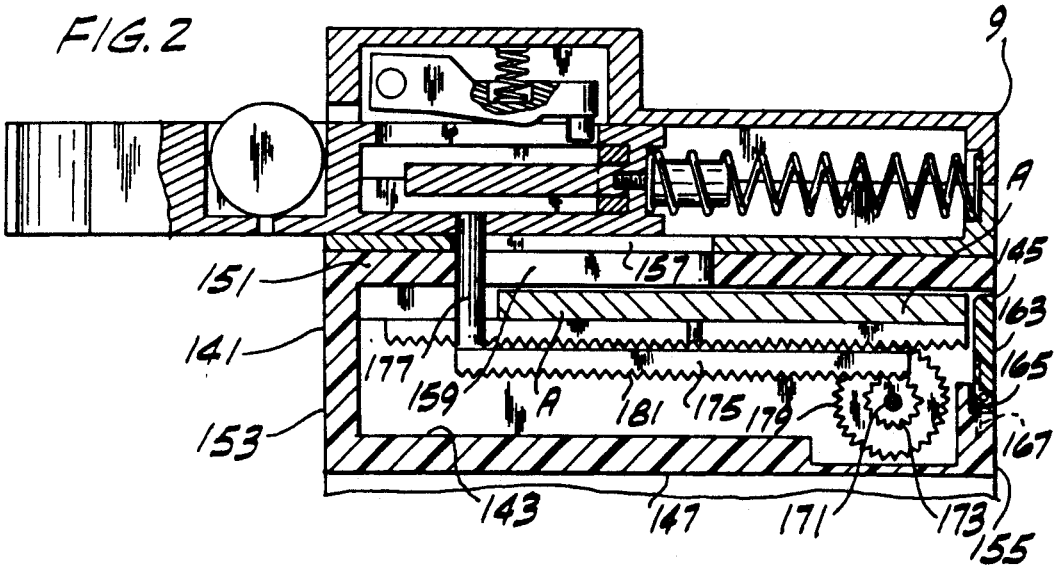
FIG. 2 is vertical longitudinal section of a coin-controlled mechanism of the apparatus, generally on line 2—2 of FIG. 1C, showing the coin slide of the mechanism in a rearward position (its outer or retracted position) with respect to the body of the mechanism, in which it is slidable, and showing the calculator in its retracted position in its housing.
Figure 3A:
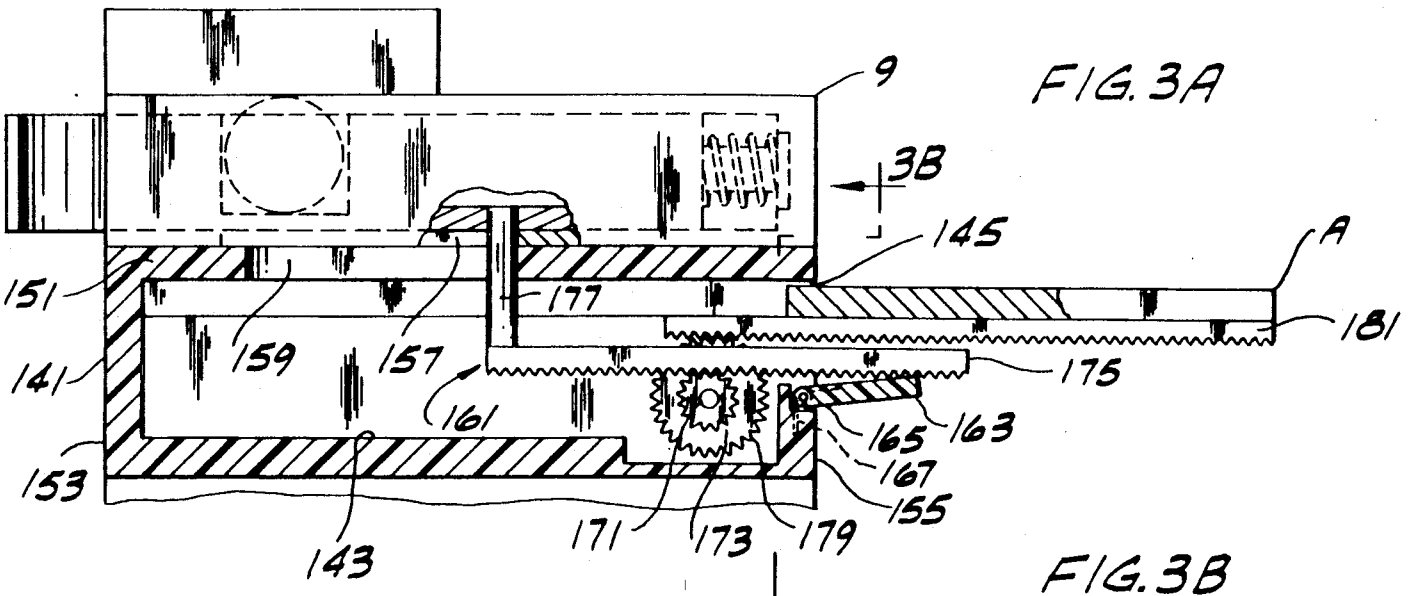
FIG. 3A is a view similar to FIG. 2 showing the calculator in its extended position.
Figure 3B:
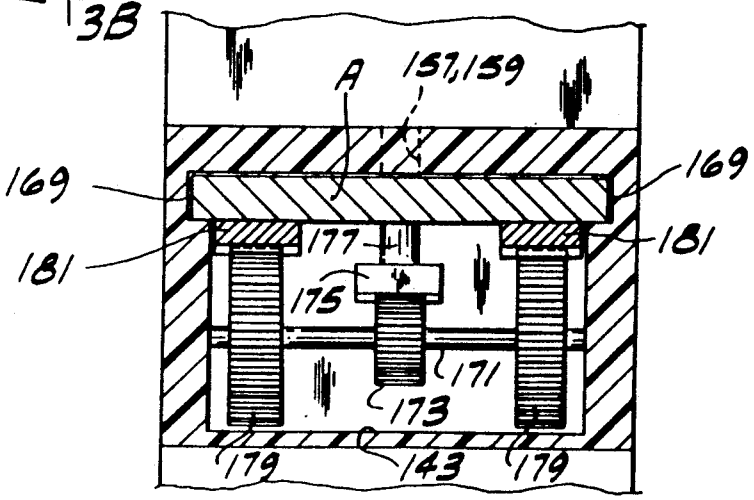
FIG. 3B is a vertical transverse section on line 3B—3B of FIG. 3A.

The calculator A is movable in the chamber 143 between the retracted position housed within the chamber in which it is shown in FIG. 2 and the extended position projecting out of the recess 143 through the opening 145 in which it is shown in FIG. 3, for use by a shopper using the cart, as for totalling the prices of items selected by the shopper and placed in the cart. Means indicated generally at 161 interconnects the coin slide 25 of the coin mechanism 3 and the calculator for moving the calculator forward to its FIG. 3 extended position when the coin slide is moved forward to its forward position and for moving the calculator back rearward to its FIG. 2 retracted position when the coin slide is moved rearward to its retracted position. The housing has a door 163 for closing the opening 145 at the forward end of the housing when the calculator is in its retracted position within the housing, the door opening on forward movement of the calculator and closing on retraction of the calculator into the housing. For this purpose, the door is pivoted as indicated at 165 at the top of the partial forward end wall of the housing (i.e., at the bottom of the opening 143), and is biased closed by means of a spring such as indicated at 167. The arrangement is such that on forward movement of the calculator its forward end engages the door and swings it down and open, the door closing automatically under the spring bias when the calculator is retracted into the housing 141.

The side walls of the housing 141 have grooves 169 on the inside extending lengthwise of the housing adjacent the top of the housing serving as guideways receiving the sides of the calculator with the calculator slideable in these grooves. It will be understood that the slide moves through a predetermined stroke in moving between its rearward and forward positions (see FIGS. 2 and 3) and the means 161 interconnecting the slide and the calculator comprises motion-multiplying means for moving the calculator through a greater distance than the stroke of the slide for increased projection of the calculator from the housing. The motion-multiplying means comprises a shaft 171 rotatable in the housing 141 on an axis extending transversely with respect to the housing. Keyed on the shaft generally at the center thereof is a relatively small diameter pinion 173. A rack 175 movable endwise in the housing meshes with the pinion. Means constituted by a pin 177 extends down from the slide through the registering slots 157,159 is connected to the rack for rotating the shaft on movement of the slide. The pin extends down in the housing rearward of the rearward end of the calculator. Two large-diameter pinions each designated 179 are keyed on the shaft adjacent its ends at the sides of the housing, and two racks each designated 181 are provided on the bottom of the calculator adjacent opposite sides of the calculator, each rack being in mesh with a respective large-diameter pinion.

When a coin has been inserted in the coin recess 119 and the slide 25 pushed forward to its forward limit to unlock the latch bar 5, the rack 181 moves forward with the slide and rotates the shaft 171 via the small diameter pinion 173 in the direction for the large-diameter pinions 179 to act via the racks 181 on the bottom of the calculator A to push the calculator forward and out of the housing to the extended position shown in FIG. 3 wherein the calculator's key pad is readily accessible to the person using the cart for summing up the cost of items selected. The door 163 is opened against its closing bias by the engagement of the forward end of the calculator and then the rack 175 with the door. The calculator is moved back to its retracted position and the door is closed on movement of the slide 5 back to its rearward position. The motion-multiplying means 161 moves the calculator through a greater distance than the stroke of the slide so that the calculator key pad is exposed for operation of all its buttons. The calculator is retained by the mechanism 161 in association with the lock mechanism 3 against pilferage.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. In a coin-controlled apparatus for locking shopping carts together in nested series comprising coin-controlled mechanism which is mounted on a cart and which is adapted for receiving and releasably locking therein a bar on a tether attached to the next cart in the series; said mechanism comprising:

an elongate body having a top, bottom, sides and rearward and forward ends, with an elongate slideway for a coin slide extending therein from the rearward end thereof toward the forward end, said body being adapted for being mounted in a generally horizontal position on a shopping cart;

a coin slide slidable in the slideway having a forward and a rearward portion;

means biasing the slide toward an outer rearward position wherein its rearward portion extends out rearward of the body;

the rearward portion of the slide having a recess for holding a coin on edge therein with the coin projecting up out of the recess, the recess being located outwardly of the rearward end of the body when the slide is in its rearward position for deposit of a coin in the recess and retrieval of a coin from the recess and being located within the body when the slide is pushed inward and forward;

means for limiting the inward movement of the slide in the absence of a coin in the recess but allowing inward movement of the slide to a forward position inward of the limit as long as a coin is placed in the recess;

means for locking the bar on the tether attached to the next cart in the series in the body, said locking means releasing the bar on inward movement of the coin slide to its forward position following insertion of a coin in the recess;

characterized in having a calculator housing at the bottom of the body, said housing having a chamber therein extending lengthwise with respect to the body and an opening at the forward end of the housing;

a calculator movable in the chamber between a retracted position housed within the chamber and an extended position projecting out of the chamber through said opening for use by a shopper using the cart; and means interconnecting the slide and the calculator for moving the calculator forward to its extended position when the slide is moved forward to its forward position and moving the calculator rearward to its retracted position when the slide is moved rearward to its rearward position.

2. Apparatus as set forth in claim 1 wherein the calculator housing has a door for closing the opening at the forward end of the housing when the calculator is in its retracted position within the housing, the door opening on forward movement of the calculator and closing on retraction of the calculator into the housing.

3. Apparatus as set forth in claim 2 wherein the door is pivotally mounted for swinging movement relative to the housing between open and closed positions and having means for biasing the door to swing to its closed position, the calculator swinging the door open against the closing bias on forward movement of the calculator from its retracted position.

4. Apparatus as set forth in claim 1 wherein the slide moves through a predetermined stroke in moving between its rearward and forward positions and wherein the means interconnecting the slide and the calculator comprises motion-multiplying means for moving the calculator through a greater distance than the stroke of the slide.

5. Apparatus as set forth in claim 4 wherein the calculator housing has a door for closing the opening at the forward end of the housing when the calculator is in its retracted position within the housing, the door opening on forward movement of the calculator and closing on retraction of the calculator into the housing.

6. Apparatus as set forth in claim 4 wherein the door is pivotally mounted for swinging movement relative to the housing between open and closed position and having means for biasing the door to swing to its closed position, the calculator swinging the door open against the closing bias on forward movement of the calculator from its retracted position.

7. Apparatus as set forth in claim 4 wherein said motion-multiplying means comprises a shaft rotatable in the housing on an axis extending transversely with respect to the housing, a relatively small diameter pinion on the shaft, a rack movable endwise in the housing in mesh with said small-diameter pinion, means extending down from the slide into the housing connected to the rack for rotating the shaft on movement of the slide, at least one relatively large diameter pinion on the shaft rotatable with the small-diameter pinion, and at least one rack on the bottom of the calculator in mesh with said large diameter pinion.

8. Apparatus as set forth in claim 7 wherein the housing has guideways at opposite sides thereof and on the inside adjacent the top of the housing and space in the housing below the level of the quideways, the calculator being slidable at the sides thereof in said guideways, the shaft and pinions thereon being located in said space, and the means extending down from the slide into the housing to the connection with the first-mentioned rack comprising a pin extending down in the housing rearward of the rearward end of the calculator through an elongate slot extending lengthwise of the top of the housing.

9. Apparatus as set forth in claim 8 wherein the small-diameter pinion is located generally midway between the sides of the housing and wherein two large-diameter pinions are provided, one adjacent each side of the housing, and two racks are provided, one adjacent each side of the calculator on the bottom of the calculator, in mesh with the two large-diameter pinions.

* * * * *